US005950309A

United States Patent [19]

Bryce et al.

[11] Patent Number: 5,950,309

[45] Date of Patent: Sep. 14, 1999

[54] METHOD FOR BONDING A NOZZLE PLATE TO AN INK JET PRINTHEAD

[75] Inventors: Lori A. Bryce, Rochester; John R. Andrews, Fairport; William J. Greene, Williamson, all of N.Y.

[73] Assignee: Xerox Corporation, Stamford, Conn.

[21] Appl. No.: 09/004,259

[22] Filed: Jan. 8, 1998

[51] Int. Cl.[6] ..... B21H 1/04

[52] U.S. Cl. ..... 29/890.1; 29/25.35; 29/464; 29/743

[58] Field of Search ..... 29/890.1, 25.35, 29/611, 464, 743, 760, DIG. 44; 347/47; 269/21; 156/272.8, 556

[56] References Cited

U.S. PATENT DOCUMENTS

| | | | |
|---|---|---|---|
| 4,638,337 | 1/1987 | Torpey et al. . | |
| 4,975,143 | 12/1990 | Drake et al. | 269/21 |
| 4,999,077 | 3/1991 | Drake et al. | 29/464 |
| 5,098,503 | 3/1992 | Drake | 269/21 |
| 5,297,331 | 3/1994 | Childers | 29/611 |
| 5,434,607 | 7/1995 | Keefe . | |
| 5,493,320 | 2/1996 | Sandbach, Jr. et al. . | |
| 5,546,654 | 8/1996 | Wojnarowski et al. | 29/743 |
| 5,617,128 | 4/1997 | Thoman et al. | 347/47 |
| 5,623,754 | 4/1997 | Swann et al. | 29/464 |
| 5,642,641 | 7/1997 | Maxfield, Jr. et al. | 29/464 |
| 5,779,837 | 7/1998 | Harvey | 29/890.1 |
| 5,826,333 | 10/1998 | Iketani et al. | 29/890.1 |
| 5,855,713 | 1/1999 | Harvey | 156/272.8 |

FOREIGN PATENT DOCUMENTS

| | | | |
|---|---|---|---|
| 534765-A1 | 3/1993 | European Pat. Off. | 29/743 |

*Primary Examiner*—Irene Cuda
*Assistant Examiner*—Trinh T. Nguyen

[57] ABSTRACT

A method is disclosed for bonding a nozzle plate to the front nozzle face of a printhead. A bonding station includes a heated printhead holder in opposed relationship to a nozzle plate holder with a curved lower surface. A nozzle plate having a row of nozzle holes and alignment apertures are formed by laser ablation in a thin polymer film. The film is moved into the bonding station, and the nozzle plate is aligned with pins on the curved nozzle plate holder surface. Both the printhead holder and nozzle plate holder are adjustable in directions perpendicular to the nozzle array on the printhead face and also rotationally. The adjustment insures that the nozzle plate, with adhesive applied to the bottom surface, makes initial tangential contact at the center of the nozzle array, resulting in accurate alignment of the nozzle plate holes with the nozzle array in the printhead face.

3 Claims, 4 Drawing Sheets

METHOD FOR BONDING A NOZZLE PLATE TO AN INK JET PRINTHEAD

BACKGROUND OF THE INVENTION AND MATERIAL DISCLOSURE STATEMENT

The present invention relates generally to ink jet printheads and, more particularly, to an improved method and apparatus for bonding a nozzle plate to the nozzle face of an ink jet printhead.

In ink jet printing, a printhead is usually provided having one or more ink-filled channels communicating with an ink supply chamber at one end and having an opening at the opposite end, referred to as a nozzle. These printheads form images on a recording medium such as paper by expelling droplets of ink from the nozzles onto the recording medium. The ink forms a meniscus at each nozzle prior to being expelled in the form of a droplet. After a droplet is expelled, additional ink surges to the nozzle to reform the meniscus. An important property of a high quality printhead array is good jet directionality. Good jet directionality ensures that ink droplets can be placed precisely where desired on the print document. Poor jet directional accuracy leads to the generation of deformed characters and visually objectionable banding in half tone pictorial images.

A major source of ink jet misdirection is associated with improper wetting of the nozzle surface of the printhead which contains the array of nozzles; e.g., the nozzle face. One factor which adversely affects jet directional accuracy is the interaction of ink accumulating on the nozzle face of the printhead array with the ejected droplets.

Various techniques have been used to reduce or eliminate the ink accumulation to improve directionality at the nozzle face. A preferred technique is to bond a thin polymeric film (referred to as a nozzle plate) to the printhead nozzle face and, using a mask, form holes through the film connecting to the channels of the printhead. This technique is disclosed, for example, in U.S. Pat. Nos. 5,434,607 and 5,493,320.

A preferred method for forming the holes in a nozzle plate is by laser ablation. For this technique, as shown in FIG. 1, a UV excimer laser 2 emits a beam of radiation which is directed through holes 4 of a mask 6 to a portion of a thin polymeric film 8, a portion of which will form a nozzle plate 10. The energy level and pulse repetition rate of the laser are controlled to form nozzle holes 12 in plate 10. Plate 10 is then aligned with nozzles 14 formed on the front face 16 of a printhead 18. Further details of a nozzle plate formed by laser ablation are disclosed in co-pending application U.S. Ser. No. 08/818,846 filed on Mar. 17, 1997 abandoned Apr. 30, 1998 and assigned to the same assignee as the present invention. This application, and the patents referenced supra, are hereby incorporated by reference.

For all the above-cited prior art references, the nozzle plate must be securely bonded to the nozzle face of the printhead and must be accurately aligned so that the holes formed in the nozzle plate are in precise alignment with the nozzle orifices; e.g., that holes 12 are aligned with holes 14. There is a continuing need for an accurate bonding and alignment process.

SUMMARY OF THE INVENTION

It is desirable to provide a method for bonding a nozzle plate to a printhead so that the nozzle plate apertures or holes are precisely aligned with the nozzle orifices of the printhead. This is accomplished, according to the invention, by securing the nozzle plate against a curved surface of a nozzle plate holder, thus, imparting curvature and rigidity to the nozzle plate. The nozzle plate is then tangentially aligned through the plane of the nozzle face. Once tangential contact is made, the nozzle plate is lowered into binding contact, with first order alignment accomplished by slots through the nozzle plate referenced to pins on the holder and film held in place with vacuum.

More particularly, the present invention relates to a method for bonding a nozzle plate to a printhead nozzle face at a bonding station which includes a nozzle plate holder having a concave bottom surface, the nozzle plate holder positioned opposite a printhead holder, and including the steps of:

forming a nozzle plate from a thin polymeric film having a thin adhesive layer on a bottom surface, the nozzle plate having a plurality of holes forming a linear array, and having further formed therethrough a plurality of alignment apertures, placing the nozzle plate into a bonding station, securing the plate to the curved bottom surface of the nozzle plate holder by vacuum means, aligning the nozzle plate by securing the alignment apertures of the nozzle plate over alignment pins on the nozzle plate holder curved bottom surface, thereby locating the linear array of holes in the nozzle plate on a line perpendicular to the curved bottom surface, seating a printhead in the printhead holder with a nozzle face having a nozzle array in an upward direction, providing a first, coarse alignment of the nozzle plate to the printhead face in a direction perpendicular to the nozzle array, making fine translational and rotational alignments of the nozzle plate holder and printhead holder so that the nozzle holes and the nozzle plate are precisely aligned with the nozzles of the printhead nozzle array, lowering the nozzle plate into tangential contact with the printhead face providing a rotational adjustment of the nozzle plate holder until the initial contact point is along the center of the nozzle array, applying further downward pressure to bond the nozzle plate to the printhead nozzle face and curing the bonded surface.

DESCRIPTION OF THE INVENTION

Figure 1:
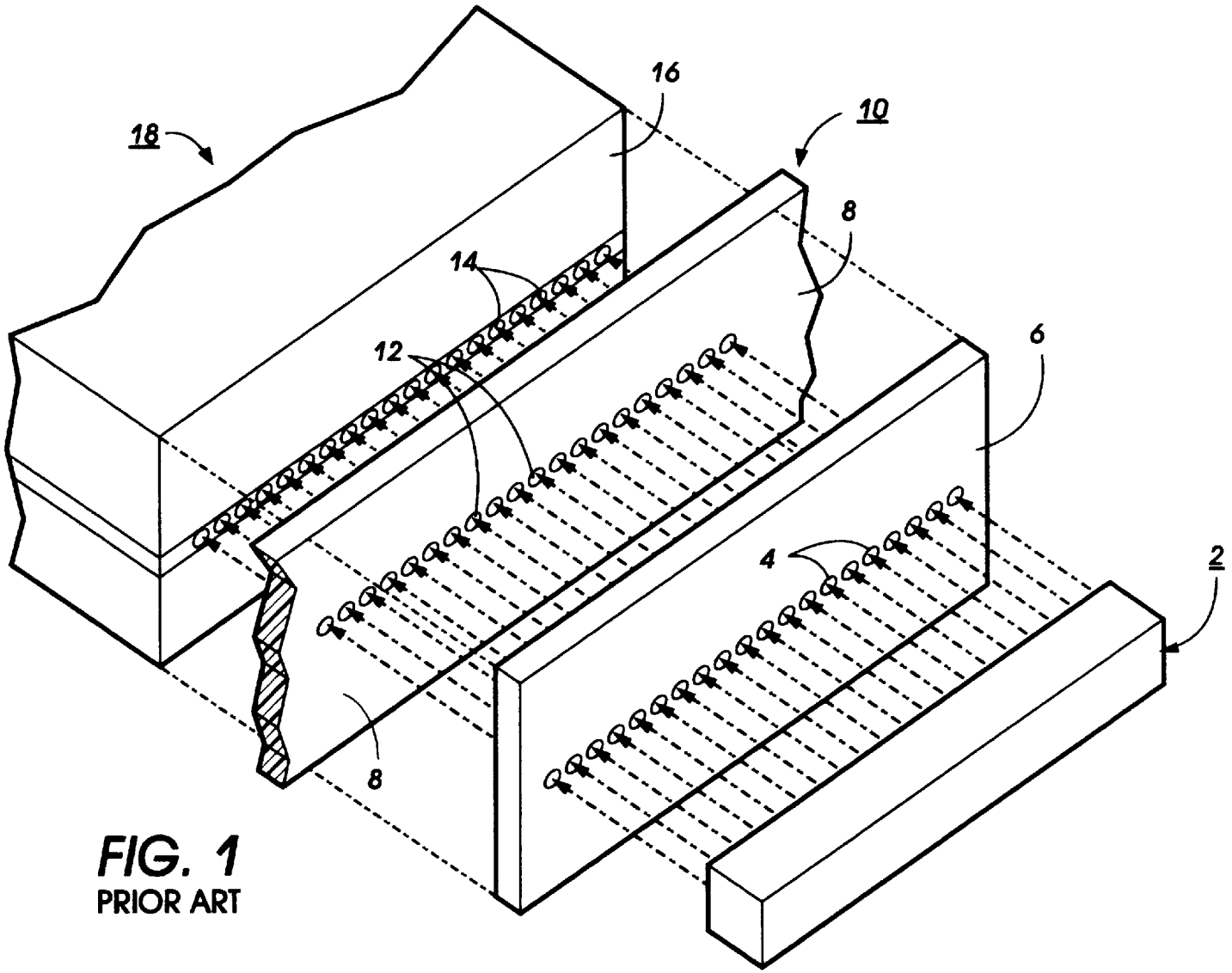
FIG. 1 PRIOR ART
FIG. 1 is a prior art exploded view of a laser ablated nozzle plate bonded to a printhead nozzle face.
Figure 2:
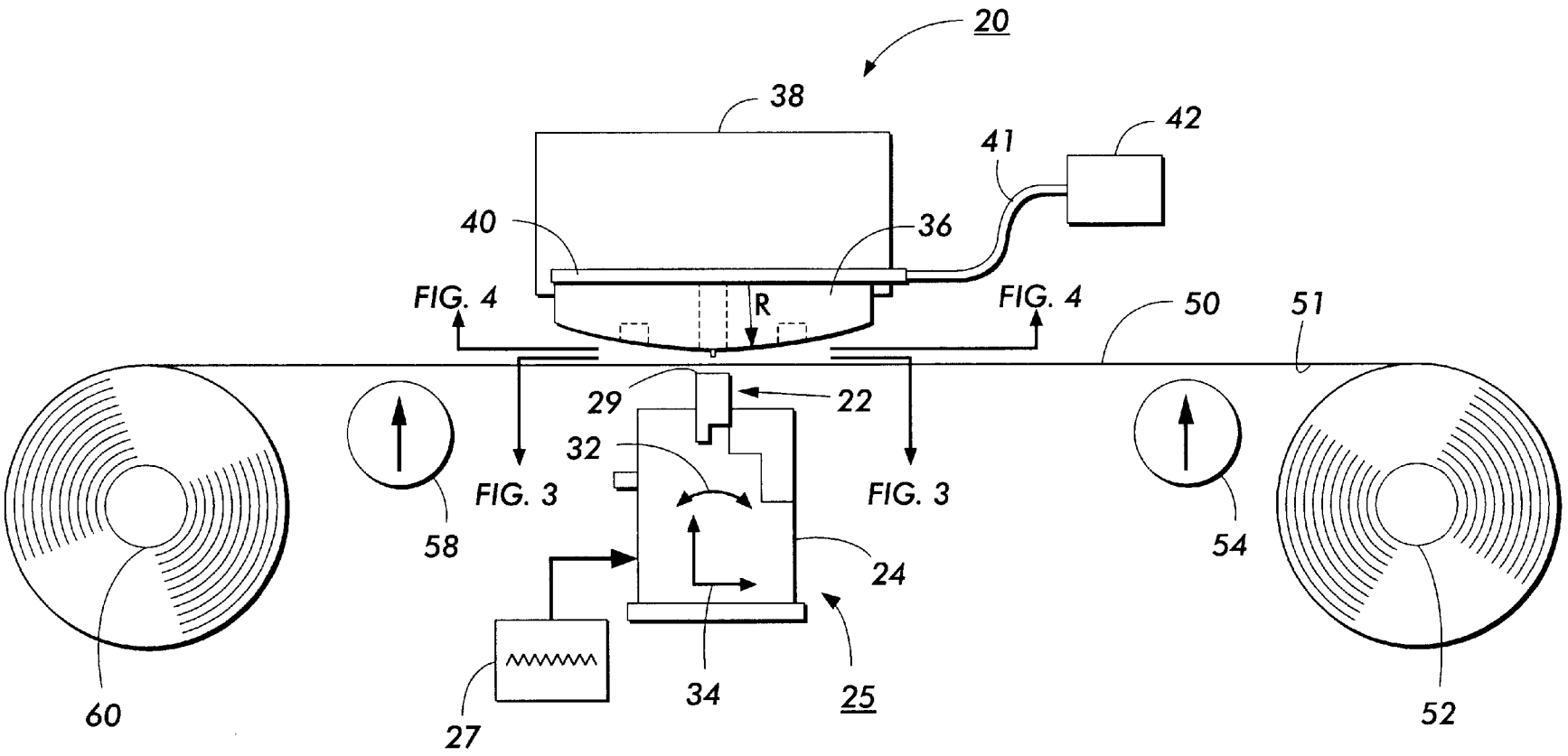
FIG. 2 is a side view of an apparatus for bonding a nozzle plate to a printhead nozzle face according to the invention.
Figure 3:
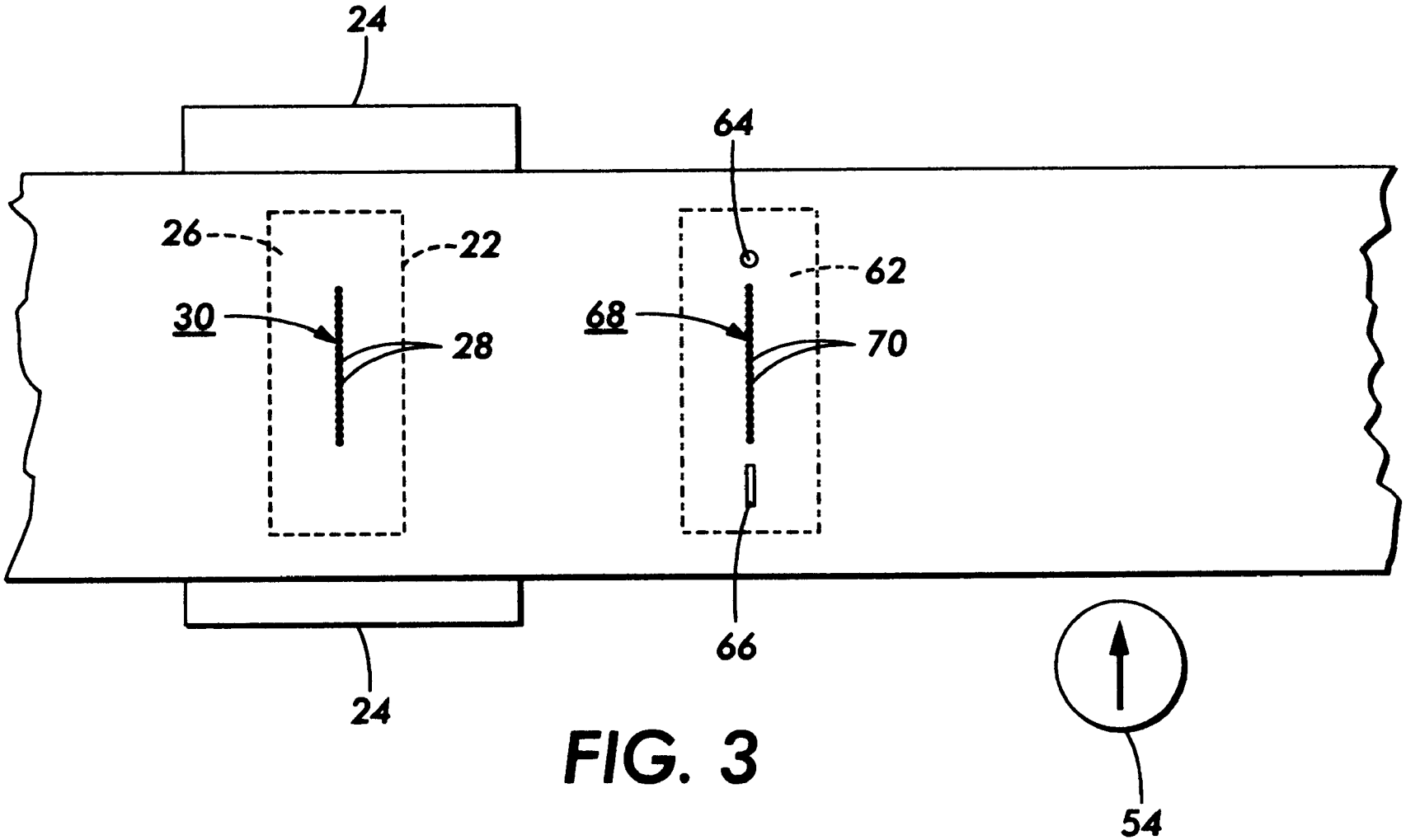
FIG. 3 is a partial top view of the FIIG. 2 apparatus showing the printhead holder.

FIG. 2 shows a side view of an apparatus 20 for aligning a previously formed nozzle plate to a printhead nozzle face and for bonding the plate to the nozzle face after a critical alignment position has been secured. FIG. 3 shows a top view of a portion of FIG. 2. An ink jet printhead 22, which, in a preferred embodiment, is fabricated by the process disclosed in U.S. Pat. No. 4,638,337, whose contents are hereby incorporated by reference, is held in a printhead holder 24 located in an alignment and bonding station 25.

The holder 24, in a preferred embodiment, is heated by a heater 27. The printhead is held so that nozzle face 26, with a plurality of nozzle 28 forming a nozzle array 30 along its length, is aligned in a horizontal plane. Printhead holder 24 can be moved along rotational axis 32 and translated over axis 34 for purposes described below.

Figure 4:
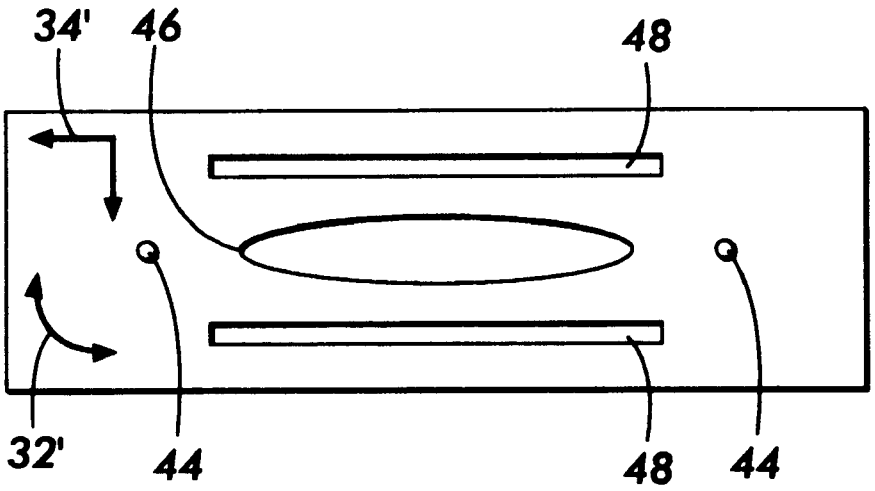
FIG. 4 is a bottom view of the nozzle plate holder.

Located above, and opposite to holder 24, is nozzle plate holder 36 having a concave bottom surface attached to an upper fixture 38. Fixture 38 movable in a vertical direction has an air passageway 40 connected by flexible tube 41 to a vacuum source 42. Curved nozzle plate holder 36, having a concave bottom surface with a radius of curvature r, is held in vacuum contact with the bottom of fixture 38. Holder 36, as shown in bottom view of FIG. 4, has a pair of alignment pins 44 projecting therefrom, a centrally located elliptical aperture 46 and a pair of slots 48 on either side of the aperture. A vacuum is applied to slots 48 through holes (not shown) formed in the bottom of fixture 38. Holder 36 can be rotated along a rotational axis 32' and translational axis 34'.

Continuing with a description of FIGS. 2 and 3, a thin polymer film 50, having a thermosetting adhesive layer 51 applied to the bottom surface, is unrolled from film supply roll 52 and passes through a nozzle plate forming station 54 and into the bonding and alignment station 25, passing through a curing station 58, and onto the take-up roll 60 driven in a counter-clockwise direction by conventional motor means. Supply roll 52 and tape-up roll 60 are aligned in substantially the same horizontal plane.

At station 54, a section of the film 50, which will be formed into a nozzle plate, is laser ablated by, for example, the techniques shown in the aforementioned application, to form nozzle and alignment holes. A nozzle plate 62 is shown in FIG. 3 following passage through station 54. Alignment holes 64 and slot 66 have been formed above and below a nozzle hole array 68 comprising nozzle holes 70 which are to be aligned with nozzles 28 on nozzle array 30, followed by bonding of the nozzle plate to the printhead face 29. Alternately, the nozzle plates may be formed at another location and rolled onto supply roll 52. For this embodiment, station 54 is not required.

Prior to a fine alignment and bonding step, a gross alignment of the nozzle plate hole array 68 to the printhead nozzle array 30 in the direction perpendicular to array 30 is made. This is accomplished by first moving a nozzle plate 62 into station 25 and referencing hole 64 and slot 66 formed in the nozzle plate to pins 44 in holder 36. This alignment insures that the nozzle hole array 68 is located on a line perpendicular to the holder radius. The gross alignment is then made by adjustments along axis 34 and 34' of the printhead holder and nozzle holder, respectively.

Following the gross adjustment, fixture 38 and holder 36 are lowered bringing the curved surface of holder 36 into contact with the film. A portion of the film formed without adhesive is pushed downward into tangential contact with the surface of nozzle array 30. To insure that the initial tangential contact point is along the center of array 30 in a direction into the page, rotational adjustments are made along axis 32, 32' until white light interference fringes are observed at the desired contact point. The interference fringes are produced by conventional optical means.

Figure 5:
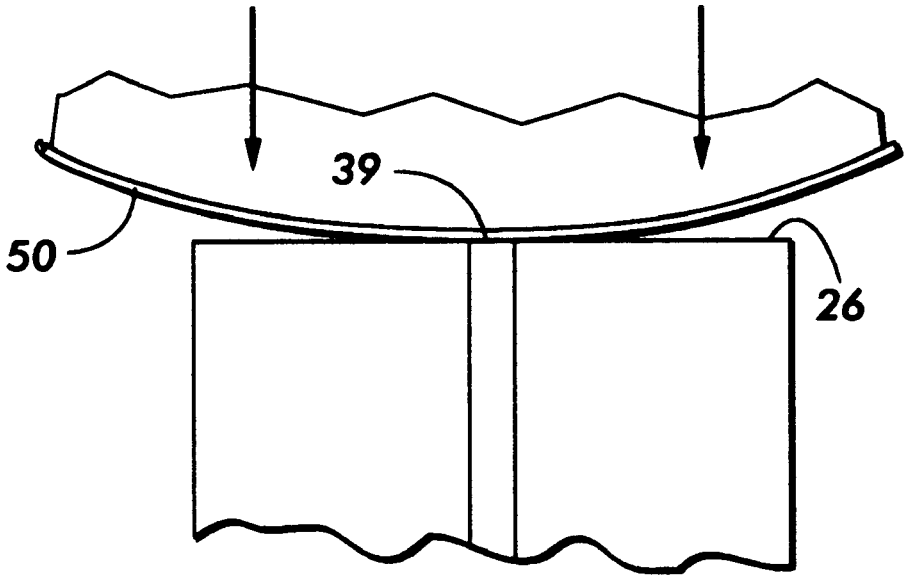
FIG. 5 is a side view of the nozzle plate film being bonded to the printhead nozzle face.

Following the nozzle plate holder rotational adjustment, a final fine alignment is made of nozzles 28 to nozzle plate hole 70, directed primarily at alignment of the nozzle hole array 68 to nozzle array 30. This is accomplished by fine adjustments along the rotational axis 32, 32' and translation axis 34, 34'. Once this final alignment is complete, the nozzle plate is fully lowered into tangential contact with the nozzle face. Because of the curvature of holder 36, the plate is also curved and acquires an increase in rigidity that allows firm downward pressure to be applied all along the contact areas as shown in FIG. 5. Once there is initial contact, the Film 50 containing plate 62 continues to be lowered so as to bond to the entire surface of the printhead face (not specifically at the center near the array). This can be done because the film is not being held rigidly along the printhead nozzle face. The elliptical aperture 46 allows the film to flex so that, as the film continues to be lowered, it flattens along the tangent (see FIG. 5) allowing contact along the entire face.

The thermal setting adhesive applied along the bottom surface of the film at station 54 wets the nozzle face 26 and begins to cure immediately since the printhead has been, and continues to be, preheated. After a few minutes, the vacuum is released and the film, with bonded printhead attached, moves to curing station 58 for additional and final curing of the adhesive. The printhead assembly can then be individually separated at this point by cutting out the printhead assembly leaving a film border to be taken up onto roll 60.

It will be appreciated that the apparatus 20, shown in FIG. 2, can be fully automated so that a plurality of nozzle plates are formed in film 50 and bonded to a plurality of printheads.

While the embodiment disclosed herein is preferred, it will be appreciated from this teaching that various alternative, modifications, variations or improvements therein may be made by those skilled in the art, which are intended to be encompassed by the following claims:

We claim:

1. A method for bonding a nozzle plate to a printhead nozzle face at a bonding station which includes a nozzle plate holder having a concave bottom surface, the nozzle plate holder positioned opposite a printhead holder, and including the steps of:

forming a nozzle plate from a thin polymeric film having a thin adhesive layer on a bottom surface, the nozzle plate having a plurality of holes forming a linear array, and having further formed therethrough a plurality of alignment apertures, placing the nozzle plate into a bonding station, securing the nozzle plate to the curved bottom surface of the nozzle plate holder by vacuum means, aligning the nozzle plate by securing the alignment apertures of the nozzle plate over alignment pins on the nozzle plate holder curved bottom surface, thereby locating the linear array of holes in the nozzle plate on a line perpendicular to the curved bottom surface, seating a printhead in the printhead holder with a nozzle face having a nozzle array in an upward direction, providing a first, coarse alignment of the nozzle plate to the printhead face in a direction perpendicular to the nozzle array, making fine translational and rotational alignments of the nozzle plate holder and printhead holder so that the nozzle holes and the nozzle plate are precisely aligned with the nozzles of the printhead nozzle array, lowering the nozzle plate into tangential contact with the printhead face providing a rotational adjustment of the nozzle plate holder until the initial contact point is along the center of the nozzle array, applying further downward pressure to bond the nozzle plate to the printhead nozzle face and curing the bonded surface.

2. The method of claim 1 wherein said printhead holder is heated thereby providing a component of the required curing.

3. The method of claim 1 wherein a plurality of nozzle plates are formed in a thin polymer film which is unrolled from a supply roll and taken up on a tape-up roll.

* * * * *